US007833077B1

(12) United States Patent
Simmons, Jr.

(10) Patent No.: US 7,833,077 B1
(45) Date of Patent: Nov. 16, 2010

(54) PIXEL BLOCKS

(76) Inventor: Felix J. Simmons, Jr., 10153 1/2 Riverside Dr. #237, Toluca Lake, CA (US) 91602-2561

( * ) Notice: Subject to any disclaimer, the term of this patent is extended or adjusted under 35 U.S.C. 154(b) by 223 days.

(21) Appl. No.: 12/082,660

(22) Filed: Apr. 14, 2008

(51) Int. Cl.
*A63H 33/08* (2006.01)

(52) U.S. Cl. ..... 446/85; 446/127

(58) Field of Classification Search ..... 446/85, 446/87, 117, 120, 121, 122, 124, 125, 127, 446/128, 96; 273/135 R, 156, 157 R
See application file for complete search history.

(56) References Cited

U.S. PATENT DOCUMENTS

| | | | | |
|---|---|---|---|---|
| 2,472,363 | A * | 6/1949 | Blackinton | 446/127 |
| 5,022,655 | A * | 6/1991 | Meyer | 273/157 R |
| 5,267,863 | A | 12/1993 | Simmons, Jr. | |
| 5,853,314 | A * | 12/1998 | Bora | 446/120 |
| 6,059,631 | A * | 5/2000 | Maddock | 446/127 |
| 6,447,360 | B1 * | 9/2002 | Sorensen | 446/124 |
| 6,558,222 | B1 * | 5/2003 | Maddock | 446/105 |
| 6,648,715 | B2 * | 11/2003 | Wiens et al. | 446/121 |
| 6,711,865 | B2 | 3/2004 | Chaudoreille | |
| 2005/0106989 | A1 | 5/2005 | Rincover | |

* cited by examiner

*Primary Examiner*—Nini Legesse
(74) *Attorney, Agent, or Firm*—J. E. McTaggart

(57) ABSTRACT

Interlocking plastic blocks, trademarked as PIXELBLOCKS, are configured to serve as basic pixels, i.e. picture elements, in the creation of a variety of two- and three-dimensional graphic artifacts. The pixel blocks can be made in various equilateral polygonal cross-sectional shapes of designated length, typically embodied in an equilateral cube shape. All side facets in the outline of cross-sectional shape, e.g. four facets of the cube, are made identical, each facet configured with a tongue alongside a groove in a symmetrical complementary configuration such that adjacent blocks can be interlocked together to form one- and two-dimensional arrays; thus pixel blocks of uniform depth front-to-back can form two-dimensional artifacts. A 3D embodiment includes posts and post holes for Z axis attachment to form multi-layer three-dimensional artifacts. By utilizing the blocks in a variety of visual properties such as color and light transmission, quantities of pixel blocks may be interlocked together to form pictures, graphics patterns, beams and other artifacts, optionally enhanced by electric lighting effects for which the pixel blocks may be specially configured.

20 Claims, 12 Drawing Sheets

PIXEL BLOCKS

FIELD OF THE INVENTION

The present invention relates to graphic arts and more particularly it relates to interlocking blocks configured as basic elements which may be combined in an interlocking manner to create two- and three-dimensional graphic art works.

BACKGROUND OF THE INVENTION

Materials and computer technology advancements have opened up the potential of new approaches to providing building blocks for graphic creations, particularly new creations or stylized reproductions of existing artwork in the form of graphics artifacts structured from assembling and joining pixels (picture elements) of uniform shape, in both two-dimensional and three-dimensional form. Field experience and further development have led to new structural improvements and other refinements.

DISCUSSION OF KNOWN ART

U.S. Pat. No. 5,267,863 issued Dec. 7, 1993 to the present inventor, disclosed INTERLOCKING PIXEL BLOCKS AND BEAMS, forming the basis of a product that has been widely marketed both nationally and internationally under the registered copyright trade name "PIXELBLOCKS". Basic pixel block units are molded in the general form of cubes approximately 3 inch per side, four side facets being each configured with a protruding tongue and a complementary groove, each generally T shaped to provide tongue and groove attachment that enables unlimited quantities of pixel blocks to be assembled in a mutually interlocked manner, similar to a jig-saw puzzle, into large area grids that can be made to form works of art utilizing pixel blocks of various color, either transparent or translucent. Experience with this known form of pixel block has led to the present invention of improvements to extend their flexibility, merit and utility.

Pub. No. US 2005/0106989 for INTERLOCKING BLOCKS, published May 19, 2005 from application Ser. No. 10/852,882 filed May 24, 2004 by Rincover and assigned to PIXELBLOCKS, LLC on Apr. 28, 2004, references provisional application 60/520,855 filed Nov. 17, 2003 and discloses variants developed in connection with research, development and marketing of pixel blocks based on the '863 patent.

OBJECTS OF THE INVENTION

It is a primary object of the present invention to provide a family of improvements applicable to known pixel blocks and thus provide a functional family of refined pixel block embodiments incorporating novel features.

It is a main object to tighten and enhance the overall structural stability of a panel assembled from a grid of pixel blocks as a departure from reliance on the circular protruding nub that was located on the tongues of early pixel blocks (claim 12 of the '863 or U.S. Pat. No. 5,267,863) for such structural stability.

It is a further object to disclose a structural modification in the shape of the pixel block that facilitates the fitting of each pixel block into another in view of small clearances and tight tolerances involved.

It is another object to disclose novel facilities for incorporating electric lighting elements and associated wiring thereof into novel embodiments of the pixel block incorporating the above objects.

It is a further object to disclose additional outline shapes other than generally square with which novel embodiments of the pixel block concept can be practiced.

It is a further object to designate larger sizes of pixel blocks that are still compatible for intermixing with known embodiments of the basic pixel blocks.

It is a further object to designate special configurations for panel edges and corners in which novel embodiments of pixel blocks can be made and practiced.

SUMMARY OF THE INVENTION

The above and other objects have been realized in the improvements disclosed in the present invention. (1) In a novel basic pixel block embodiment, panel stability is accomplished by an integral pressure bar configured that extends across each tongue the full back-to-front thickness of an assembled panel, as a two-way extension to a nub located centrally on each tongue, accomplishing a more firmly leveraged overall assembly, and (2) in a structural shape of the pixel block to facilitate the fitting of each pixel block into another in view of small clearances and tight tolerances involved, to facilitate initial entry of each pixel block to another in assembly, corner edges that interface in initial inter-assembly, including the ends of the tongues and grooves, are configured with a rounded fillet shape.

To accommodate electric wiring and/or resistor elements associated with electrical lighting, surface channel passageways are provided in strategic locations. In addition to the basic square XY shape, novel pixels blocks of the present invention may be made in other shapes, including polygons and special edge and corner pixel blocks, that can be assembled into solid panels incorporating intermixture of different shaped pixel blocks in 2D and 3D art objects.

Block sizes in multiples of the basic pixel block XY shape are disclosed in configurations that remain compatible for co-assembly with basic pixel blocks.

Using computerized scanning of an original object, pixel data of the original may be acquired and stored; from this data, artifacts may be assembled automatically from pixel blocks to produce either a likeness, or, with data manipulation, a graphically-stylized rendition.

For manual assembly, acquired pixel data may be utilized to generate a pixel map and a corresponding kit of blocks having different properties in the correct quantities, for use in industrial assembly, education, therapy, home hobbies, and such involving users of all ages.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
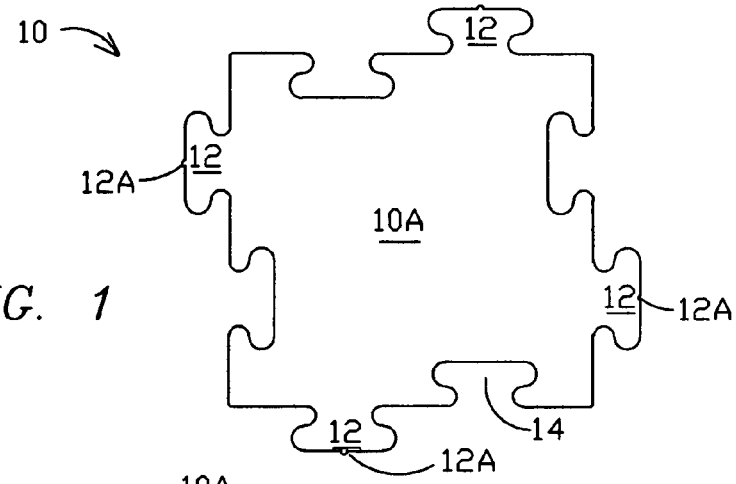
FIG. 1 depicts the front face and figured outline of a basic pixel block of the present invention.

FIG. 1 is a top view of a basic pixel block 10 of the present invention, showing the outline shape to be generally square with four identical edge patterns, each edge having an extending tongue 12 and a recessed groove 14 of similar mating shape. Tongues 12 and grooves 14 are shaped in a "jigsaw puzzle" pattern so as to mate and interlock with adjacent pixels. Located centrally on each tongue 12 is a stability bar 12A protruding from the tongue 12 approximately 0.003 inches, serving to tighten and stabilize the structure of panels assembled from pixel blocks 10.

Figure 2:
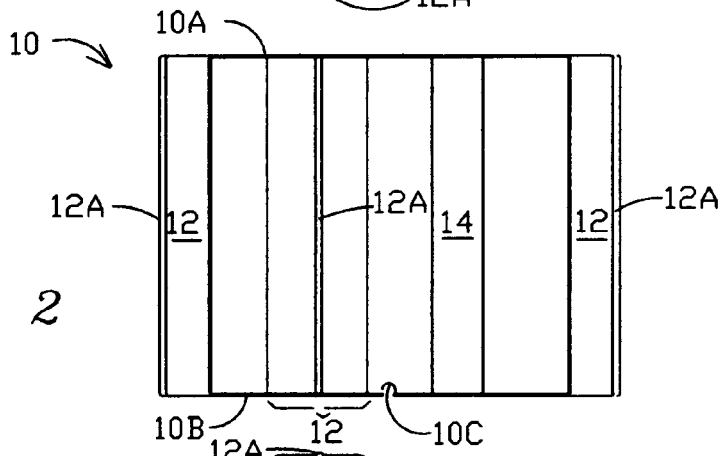
FIG. 2 depicts a side facet of the pixel block of FIG. 1.

FIG. 2 is an elevational view of the pixel block 10 of FIG. 1 showing groove 14 and three tongues 12 with associated stability bars 12A all extending uniformly from a top surface 10A (typically a front panel surface) to a bottom surface 10B (typically a rear panel surface). Stability bars 12A, typically half round in cross-sectional shape with a radius of 0.003 inches, are intended to compress slightly if necessary in assembly and provide a desired amount of friction to tighten and stabilize two-dimensional matrix panels formed from groups of pixel blocks assembled together. At a central region of the stability bar 12A there may be a small circular nub left as a by-product of the injection plastic molding process. Shown at the bottom surface 10B is the open end of an inverted-U-shaped wiring channel 10C, typically made 0.080 inches wide, configured in four places at the bottom surface 10B of each facet to accommodate electrical wiring and/or resistive components for LED or other types of lamps for lighting effects.

Figure 3:
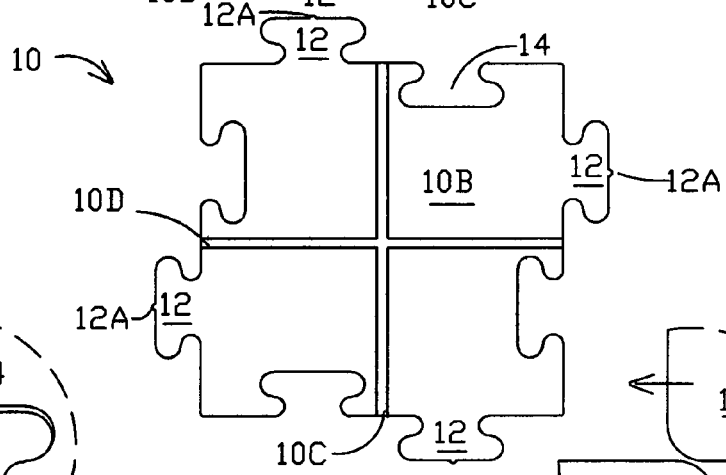
FIG. 3 depicts the rear face and reverse outline of the pixel block of FIGS. 1 and 2.

FIG. 3 is a bottom view of the pixel block 10 of FIGS. 1 and 2 showing the four tongues 12 and four grooves 14 forming an outline that is a mirror image of the outline in FIG. 1. Wiring channels 10C and 10D are seen extending fully across the pixel block 10 in X and Y directions in a centered "cross-hairs" pattern.

Figure 4:
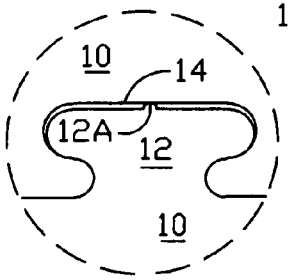
FIG. 4 is an enlarged view of a tongue of a pixel block of FIG. 1 fitted into a groove of a second similar pixel block.

FIG. 4 is an enlarged view showing a tongue 12 of one pixel block engaged with a groove 14 of a second similar pixel block. The stability bar 12A creates a small gap along the flat portion of the tongue and groove about 0.003 inches; this spacing is set by the radius of the half-round cross-section of the stabilizing bar 12A.

Figure 5:
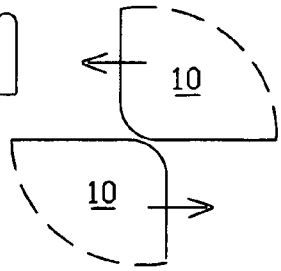
FIG. 5 is an enlarged view showing rounded corners of two pixel blocks at an initial stage of being assembled together.

FIG. 5 is an enlarged view showing typical corner edges of two pixel blocks 10 in an initial entry stage of sliding assembly together. All corners involved in such entry are rounded as shown, approximately 0.005 radius, to facilitate assembly by guiding the tongue and groove ends into each other.

Figure 6:
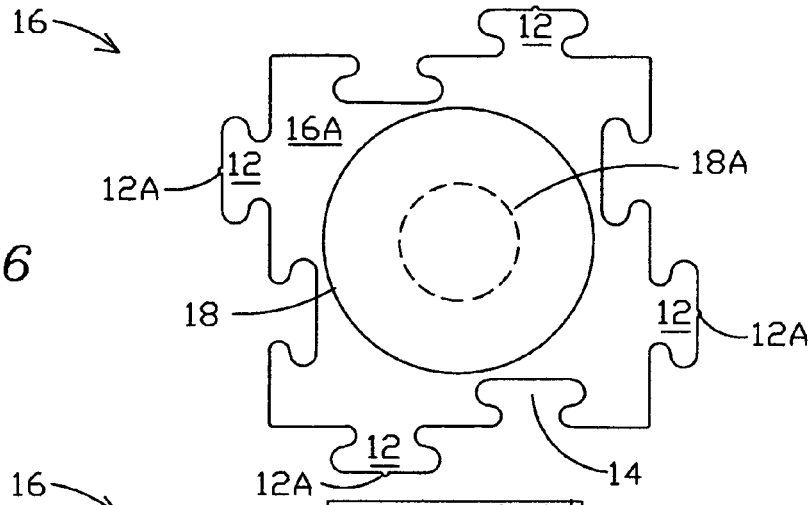
FIG. 6 depicts the front face and figured outline of a 3D pixel block embodiment.

FIG. 6 is top view of a "3D" pixel block 16, an embodiment having the same outline pattern of tongues 12, stability bars 12A and grooves 14 as in pixel block 10 of FIG. 1, but further configured with an integral cylindrical post 18 extending up from the top surface 16A to provide a 3D embodiment of the pixel block from which multiple layers of pixel blocks can be mutually attached and built-out in the Z-axis for construction of 3 dimensional objects. An internal cylindrical lamp cavity 18A is provided within post 18 for installation of a lamp for lighting effects.

Figure 7:
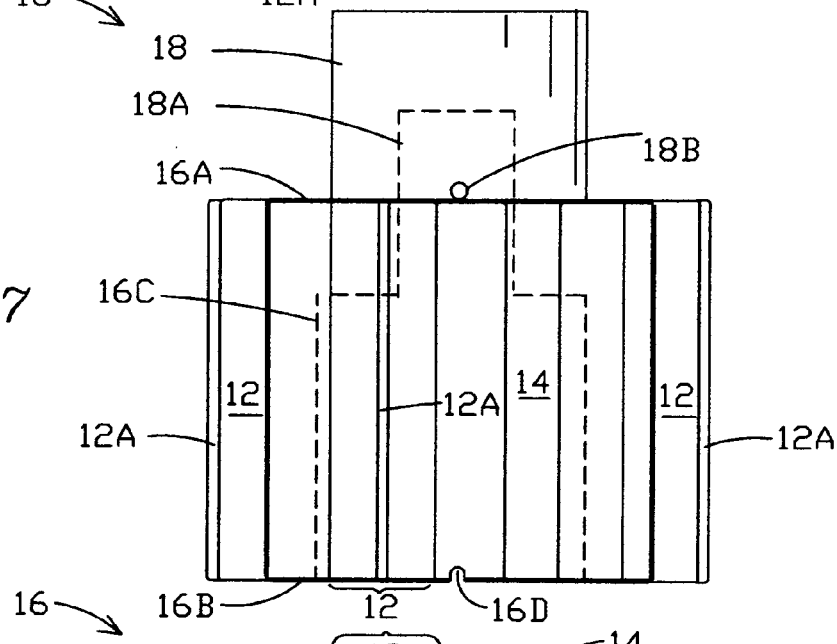
FIG. 7 is a side view of the 3D pixel block of FIG. 6.

FIG. 7 is an elevational view showing one of the four facets of the 3D pixel block 16 of FIG. 6, with groove 14, three tongues 12 and associated stability bars 12A. Also shown is a cylindrical post 18 extending upwardly from the top surface, containing a cylindrical internal lamp cavity 18A shown in broken lines. Within the main pixel block body, a cylindrical post hole 16C, shown in broken lines, is dimensioned and configured accept the post 18 of an adjoining pixel block 16 in a close friction fit so as to hold adjacent pixel block layers attached together, and to provide wiring access to the lamp cavity 18A.

As in the basic pixel block 10 (FIG. 2), one of four wiring channels 16D is visible in FIG. 7 at the bottom of the facet. Additionally a wiring passageway 18B, one of four, is visible immediately above the top surface 16A, traversing the wall of post 18 at its base so as to facilitate wiring access to the lamp cavity 18A.

Figure 8:
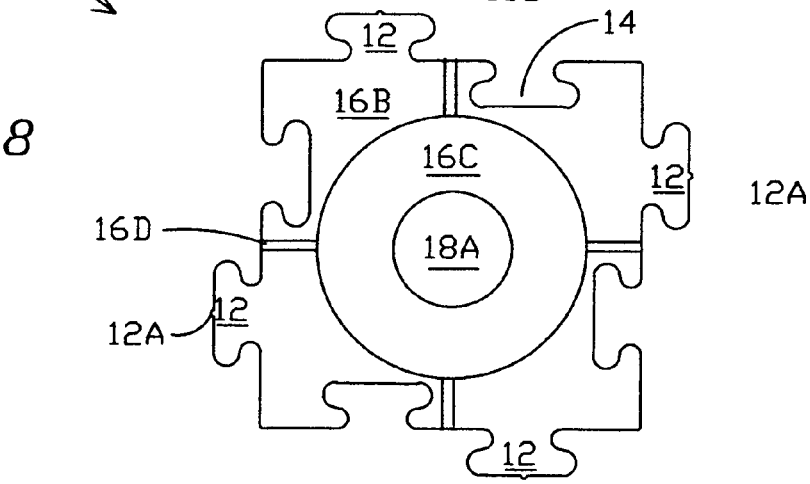
FIG. 8 depicts the reverse outline of the 3D pixel block of FIGS. 6 and 7 as viewed from the opposite face.

FIG. 8 is a bottom view of the 3D pixel block 16 of FIGS. 6 and 7, showing, in addition to four tongues 12 (each with a stability bar 12A) and four grooves 14, four wiring passageways 16D each traversing a central region of a corresponding one of the four facet sidewalls of pixel block 16. When a second identical pixel block is attached above pixel block 10, by inserting post 18 into the main cavity (16C) of the second block, the four wiring passageways (16D) at the bottom of the second block will become aligned with the four corresponding wiring passageways 18B immediately above the top surface 16A of the first pixel block 16, thus providing versatility for installing lamp wiring.

Figure 9A:
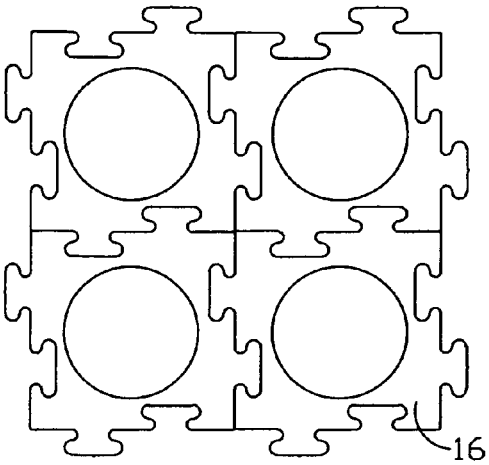
FIG. 9A depicts the face view and figured outline of a 2×2 square matrix pattern formed by four assembled 3D pixel blocks of FIG. 2.

FIG. 9A depicts the front face view and figured outline of a 2×2 square matrix pattern formed by four assembled 3D pixel blocks 16 of FIG. 2. Multiples of basic pixel block 10, or of 3D pixel block 16 of FIGS. 6-8, or mixtures thereof, can be assembled together in this same manner to create an extensive matrix panel of any desired overall size. A preferred embodiment is standardized at ¼ inch by ¼ inch, however the invention could be practiced with any designated size.

Figure 9B:
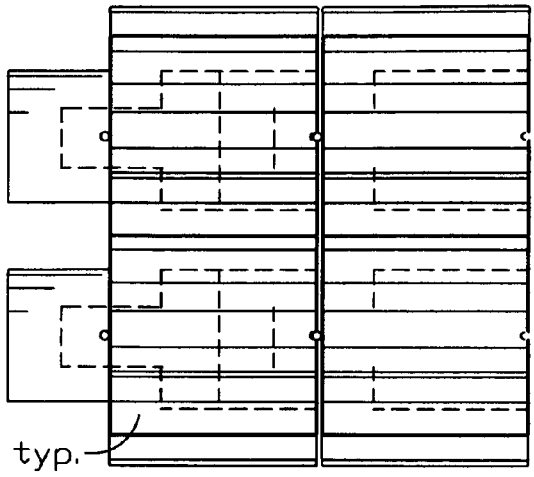
FIG. 9B is a side view of a 2×2×2 cube formed from two attached 2×2 layers of 3D pixel block as in FIG. 9A.

FIG. 9B is a side view of a 2×2×2 cube formed from a first 2×2 layer of pixel blocks 16 as in FIG. 9A stacked onto a second similar layer, thus containing a total of 9 pixel blocks.

Figure 10A:
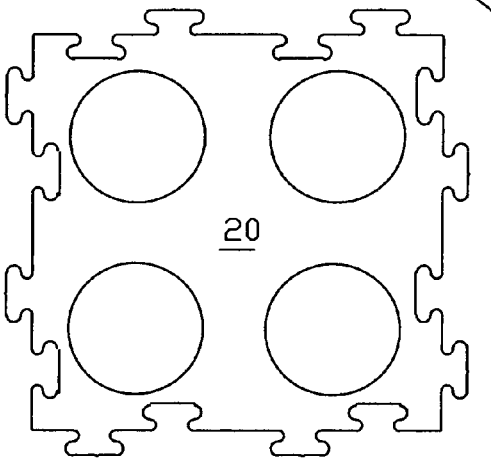
FIG. 10A is a primary face view of a single double-sized pixel block providing the same figured outline as 2×2 square matrix pattern of FIG. 9A.

FIG. 10A is a primary face view of a single enlarged cubic pixel block 20 providing the same 2×2 square matrix outline pattern as the eight block assembly in FIGS. 9A and 9B. Each enlarged pixel block 20 has four posts 18 for attaching layers together.

Figure 10B:
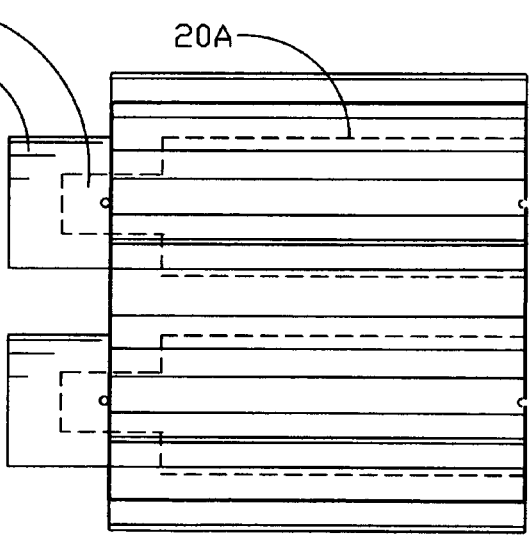
FIG. 10B is a side view of the single double-sized pixel block of FIG. 10A.

FIG. 10B is a side view depicting an edge facet of the single enlarged pixel block 20 of FIG. 10A, showing in broken lines a regular sized lamp cavity 18A in each post 18, the same as in the basic-sized 3D pixel block. however, as also shown in broken lines, the four post holes 20A extend to over twice the regular depth of post holes 16C (FIG. 7) to provide wiring access to lamp cavities 18A. Two tongues and two grooves on each edge facet in the outline pattern provide full compatibility for attachment to basic and 3D pixel blocks.

Figure 11:
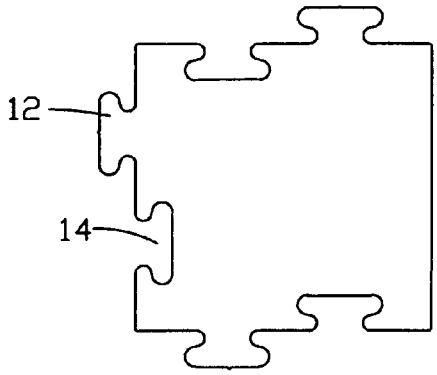
FIG. 11 is a front face view of an "end edge" pixel block.

FIG. 11 is a plan view of an "end edge" pixel block 22 made to have one of the four edges flat: only the other three sides each have a tongue 12 and groove 14. Typically pixel block 22 could be utilized around the outside edge of a matrix panel.

Figure 12:
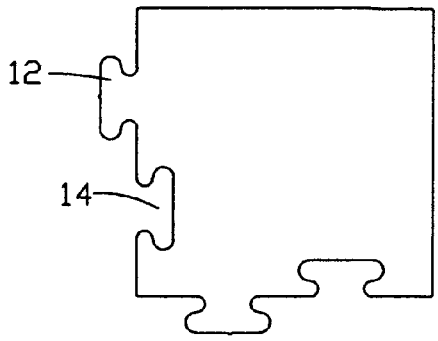
FIG. 12 is a front face view of a basic square "corner" pixel block.

FIG. 12 is a plan view of a "corner" pixel block 24 wherein two adjacent edges are made flat: the other two sides each have a tongue 12 and groove 14.

Figure 13:
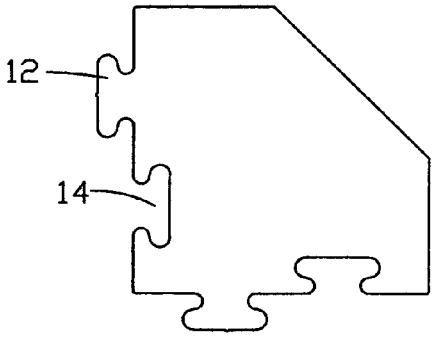
FIG. 13 is a face view of an alternative "corner" pixel block in a three-flat chamfered configuration.

FIG. 13 is a plan view of a first alternative "corner" pixel block 26 providing a chamfered pattern with three adjacent flat surfaces and two adjacent surfaces each having a tongue 12 and groove 14.

Figure 14:
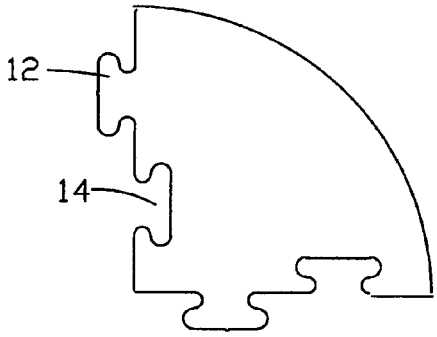
FIG. 14 is a face view of a second alternative "corner" pixel block in a quarter-round configuration.

FIG. 14 is a plan view of a second alternative "corner" pixel block 28 providing a quarter-round pattern with an arcuate surface and two adjacent surfaces each having tongue 12 and groove 14. Any of the foregoing "end edge" or "corner" outline patterns could also be applied to 3D pixel blocks 16 (FIGS. 6-8).

Figure 15:
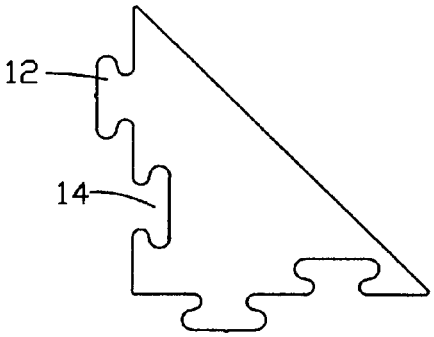
FIG. 15 is a face view of a third alternative "corner" pixel block in a diagonally-cut half-block configuration.

FIG. 15 is a plan view of a third alternative "corner" pixel block 30 constituting a diagonally-cut half-block with one flat surface and two adjacent surfaces each having a tongue 12 and groove 14.

Figure 16:
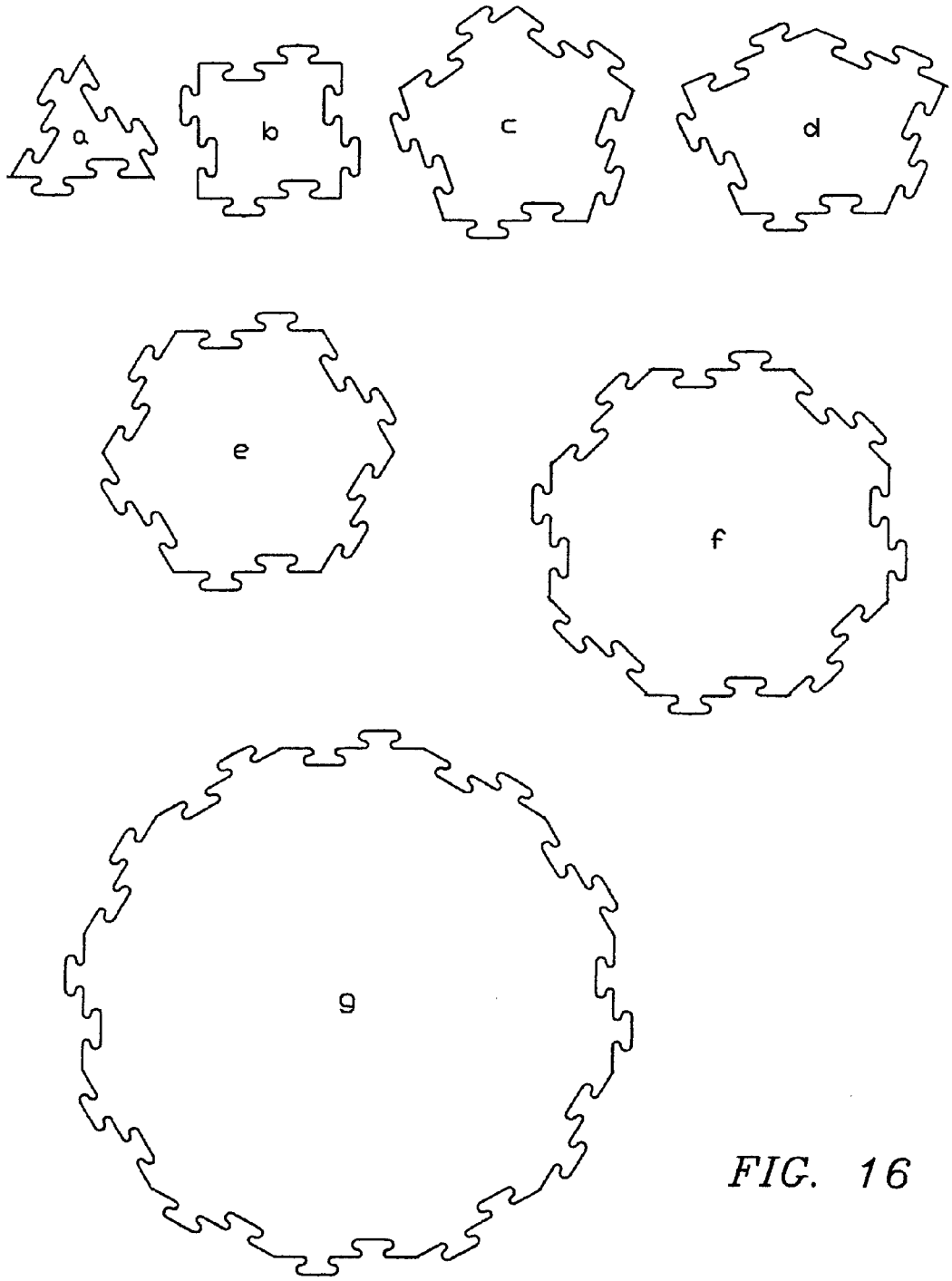
FIG. 16 depicts face views of a series of seven alternative equilateral closed plane outline shapes in which pixel blocks can be made and practiced.

FIG. 16 depicts plan views of seven examples of alternative closed plane outline shapes with different numbers of facets in which pixel blocks could be made and practiced in either 2D or 3D versions: triangle (a), square (b), pentagon (c), modified pentagon (d), hexagon (e), octagon (f) and a twelve-sided polygon (g). For purposes of facilitating intermixture, it is a principle of pixel blocks to make all of these different block shapes with all facets made equal in length. Typically the outline shapes are made radially symmetrical, i.e. all of angles between facets of a pixel block are made equal such that the corners between facets of the pixel block are located on a circle; as an exception, in modified pentagon (d) two non-adjacent angles are made to be 90 degrees to enable versatile combinations.

Figure 17:
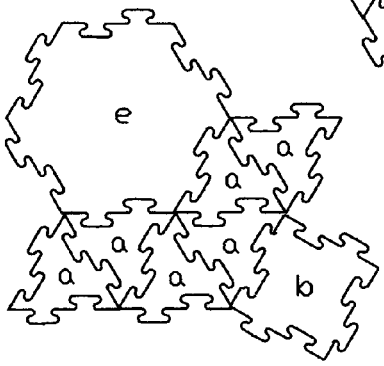
FIGS. 17-24 depict face view examples of two-dimensional graphics patterns that can be assembled from pixel blocks having shapes selected from those shown in FIG. 16.

FIG. 17 depicts a pattern formed from a mixture of three different shaped pixel blocks of FIG. 16: a, b and e.

Figure 18:
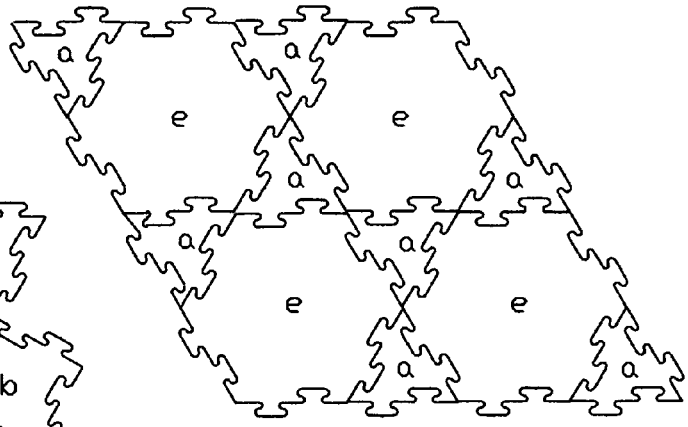
Figure 19:
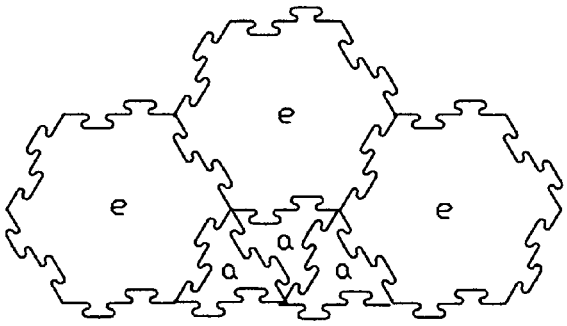

FIGS. 18 and 19 depict patterns formed from a mixture of two different shaped pixel blocks of FIG. 16: a and e.

Figure 20:
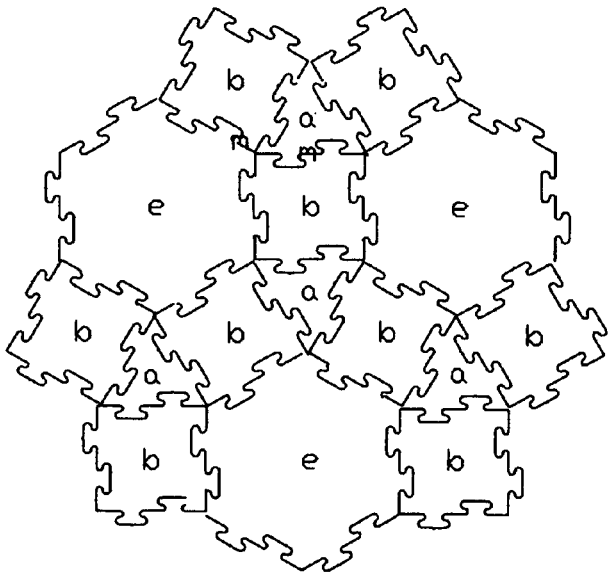

FIG. 20 depicts a pattern formed from a mixture of three different shaped pixel blocks of FIG. 16: a, b and e.

Figure 21:
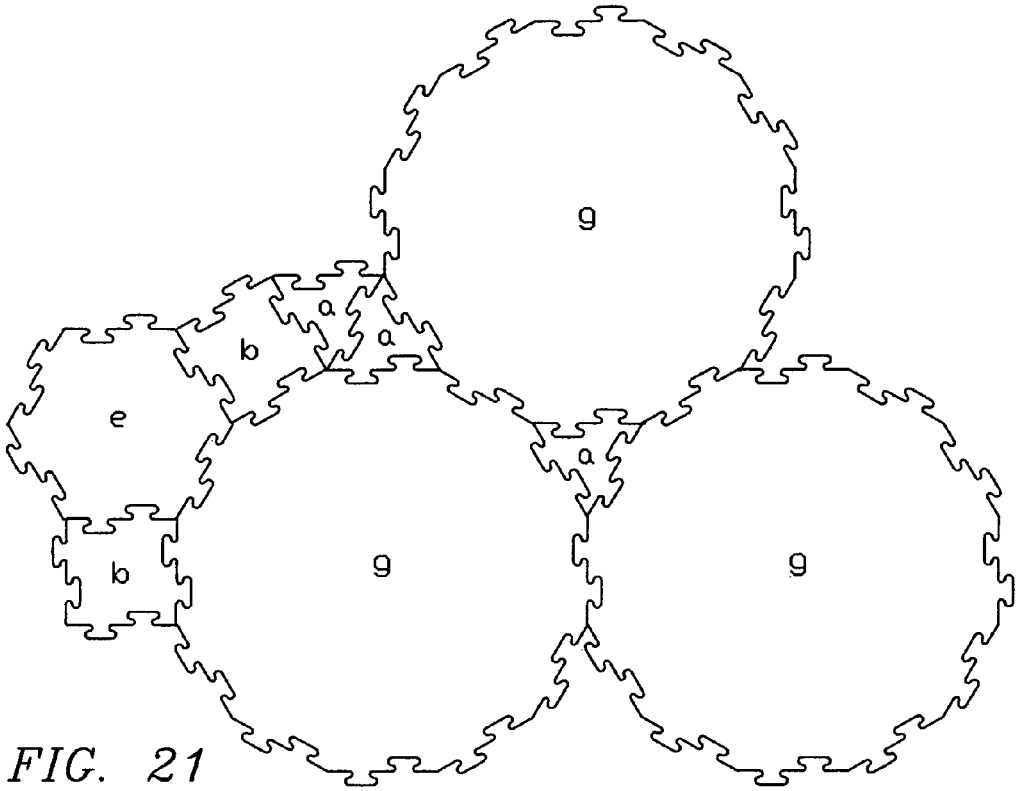
Figure 22:
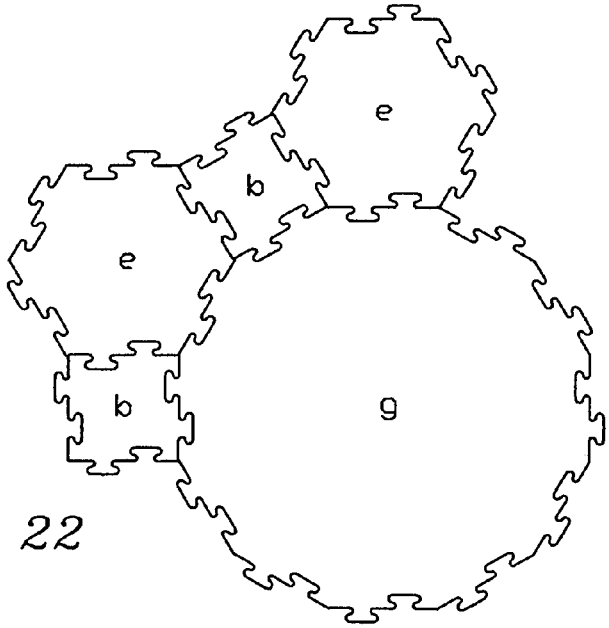

FIGS. 21 and 22 depicts patterns that can be formed from a mixture of four different shaped pixel blocks of FIG. 16: a, b, e and g.

Figure 23:
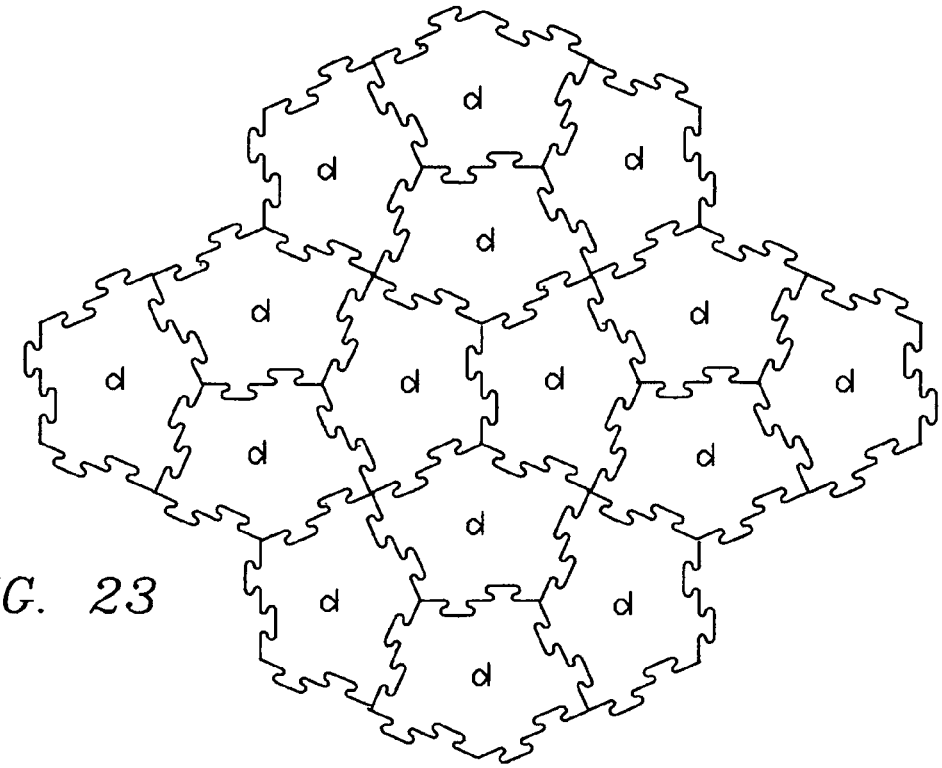

FIG. 23 depicts a pattern formed from identical pixel blocks of shape d, the modified pentagon, from FIG. 16.

Figure 24:
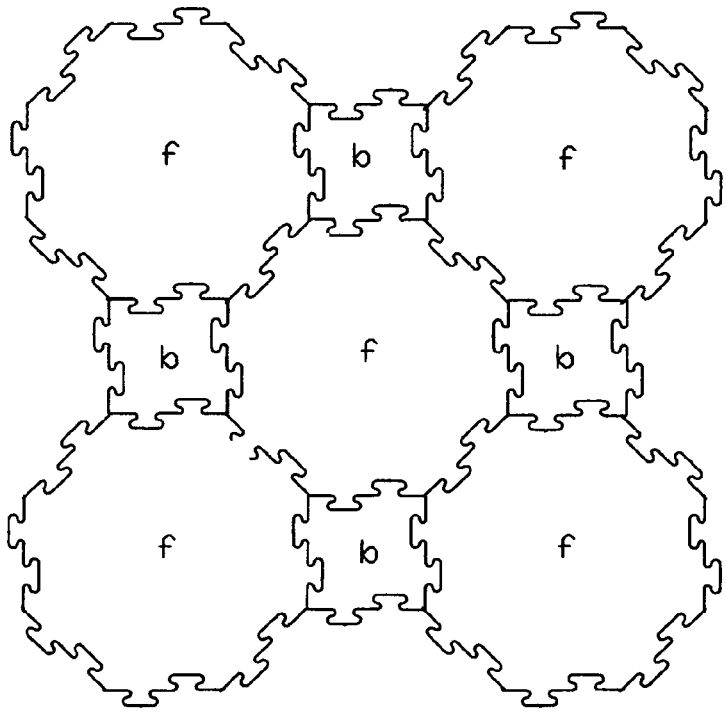

FIG. 24 depicts a pattern formed from a mixture of two different shaped pixel blocks of FIG. 16: b and f.

Figure 25:
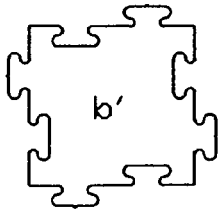
FIG. 25 depicts a face view of a special version of shape b of FIG. 16 that enables "half-stepping".

FIG. 25 shows the outline of a basic cubic pixel block with shape b' as seen from the front. The shape is a special case of shape b of FIG. 16, wherein the center-to-center spacing of each tongue and groove is made exactly half the dimension of each side of the square facet.

Figure 26:
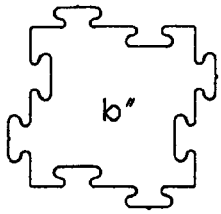
FIG. 26 depicts the reverse outline of the pixel block of FIG. 25 as viewed from the rears.

FIG. 26 shows shape b", the mirror image of outline b' of the basic cubic pixel block of FIG. 25, i.e. as it appears when viewed from the rear.

Figure 27:
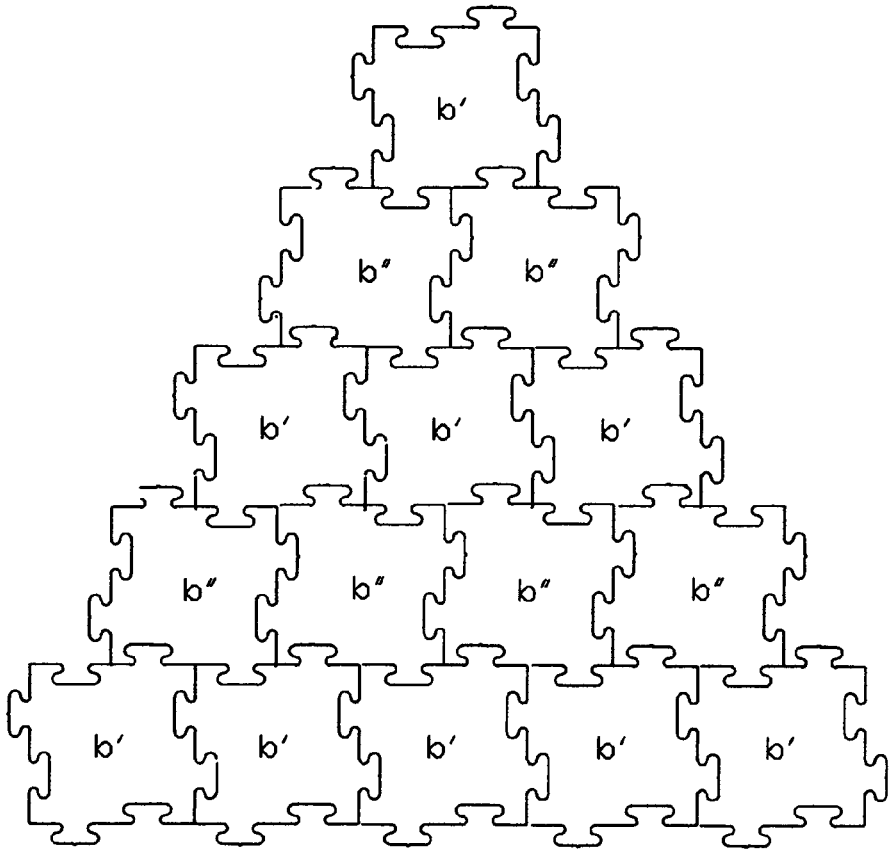
FIG. 27 depicts an example of a half-stepped triangle pattern that can be formed from the pixel block shapes of FIGS. 25 and 26.

FIG. 27 depicts a triangular pattern formed from identical pixel blocks with adjacent rows offset and alternating between outlines b' and b" respectively in a "brick wall" arrangement.

Figure 28:
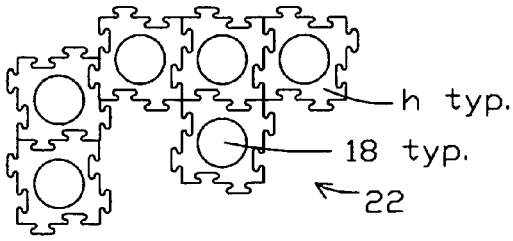
FIG. 28 depicts a group of pixel blocks assembled in an intermediate outline pattern for forming larger circular patterns.

FIG. 28 depicts a special intermediate pattern 22, intended for further "cloning", formed from six 3D type pixel blocks h with posts 18 as shown. The outline shape of pixel blocks h is a special version of the outline of 3D pixel block 16 (FIG. 6) wherein the center-to-center spacing between the tongue and the groove are made exactly half of the square block dimension and the location along the side facet is dimensioned to enable offset attachment as shown between pixel blocks h' and h" at the upper left hand corner of pattern 22.

Figure 29:
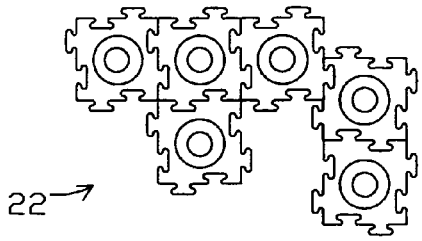
FIG. 29 depicts the reverse of the outline pattern of FIG. 28.

FIG. 29 shows a reverse view of pattern 22 of FIG. 28, as seen from the rear; post holes and optional lamp openings are seen in each pixel block in this view.

Figure 30:
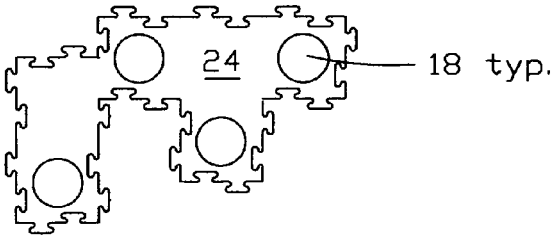
FIG. 30 depicts a single block configured with the outline pattern shown in FIG. 28 and having four posts.

FIG. 30 depicts a special enlarged intermediary pixel block 24 made to have the outline shape of pattern 22 (FIG. 28) and to have four posts 18 and four corresponding post holes, optionally including lamp openings, on the reverse side located as shown at locations of the corresponding posts in FIG. 20.

Figure 31:
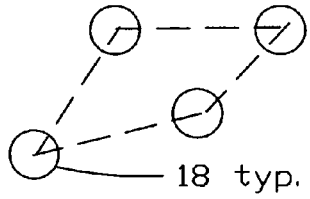
FIG. 31 depicts the "footprint" pattern of the four posts in the block of FIG. 30.

FIG. 31 depicts the four posts 18 of FIG. 30 located at the corners of a non-equilateral quadrangle, shown in broken lines.

Figure 32:
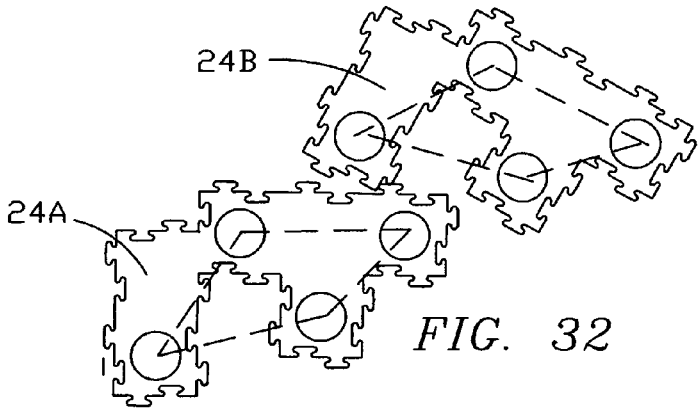
FIG. 32 depicts a uniform pattern formed by the "footprints" of two blocks of FIG. 30 in special adjacent disposition.

FIG. 32 depicts two pixel blocks 24A and 24B, each identical with pixel block 24 of FIG. 30, specially located relative to each other such that the two upper posts 18 of pixel block 24A and two lower posts 18 of pixel block 24B are positioned at the corners of the same quadrangle shape as that of the four posts on each pixel block 24A, i.e. the quadrangle shown in FIG. 31.

Figure 33:
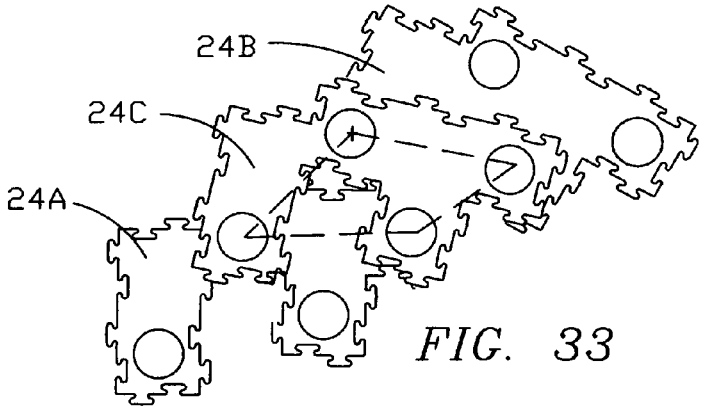
FIG. 33 depicts a 3D two-layer assembly of the two blocks of FIG. 32 as the rear layer and an additional block of FIG. 30 in front, attached together via four posts: two from each rear block.

FIG. 33 shows a third pixel block 24C added to and attached via the four posts onto the top of pixel blocks 24A and 24B of FIG. 32, forming a 3D, two-layer, self-supporting assembly of the three pixel blocks that can be further expanded in the same manner into a larger arcuate pattern or even into a full circle.

Figure 34:
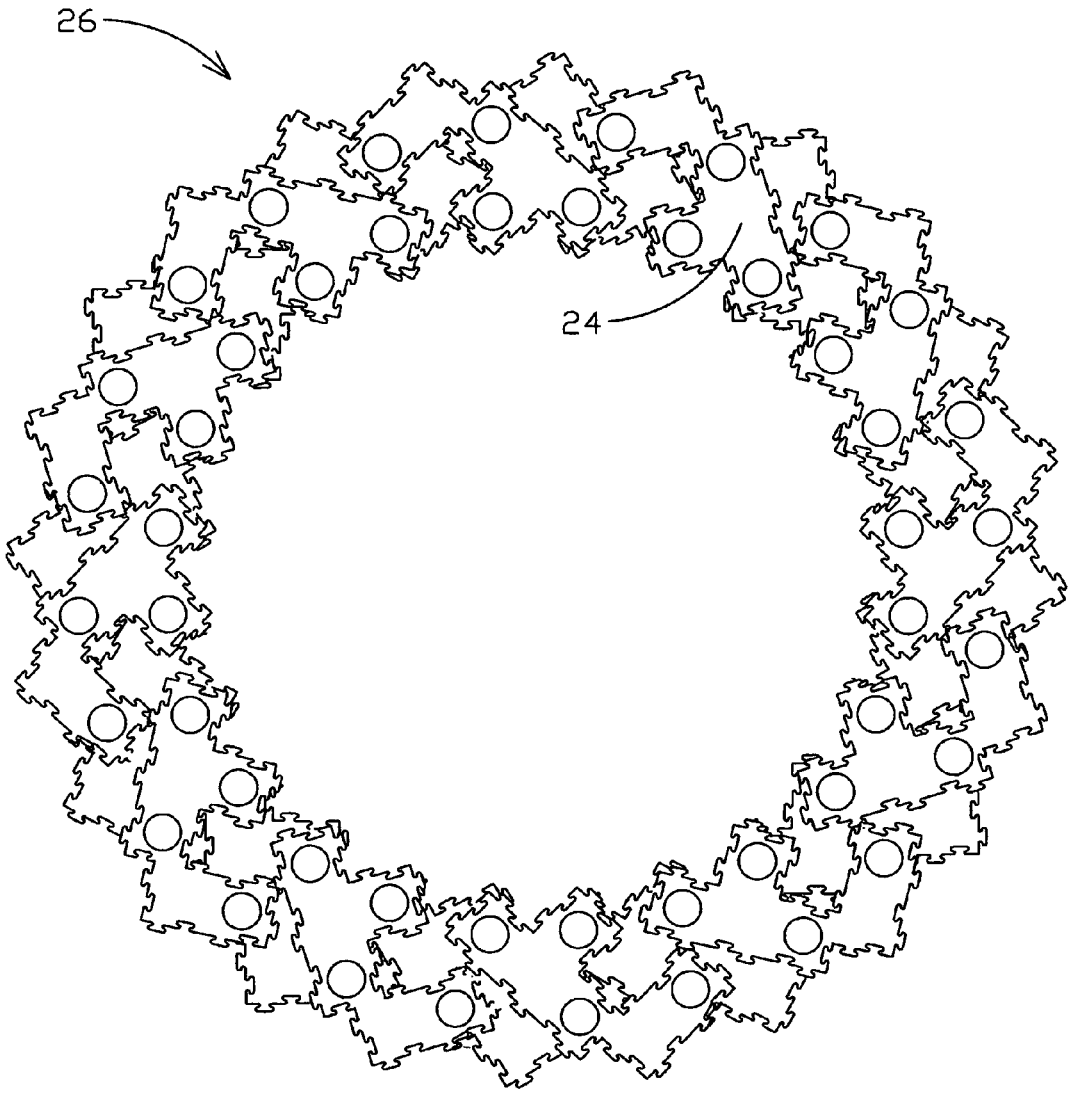
FIG. 34 depicts a large circular pattern formed form multiples of the block of FIG. 30, assembled together as depicted in FIG. 31.

FIG. 34 shows a two-layer full circle 26 formed from pixel blocks 24 assembled as a continuation of the sequence shown in FIGS. 32 and 33. Any number of additional layers can be added to the basic two-layer circle 26 to form a 3D hollow cylindrical shape of desired size. Increased diameter of the circle 26 can be provided by creating specially shaped larger intermediary pixel blocks with suitable shape derived from the shape shown in FIG. 30.

Figure 35:
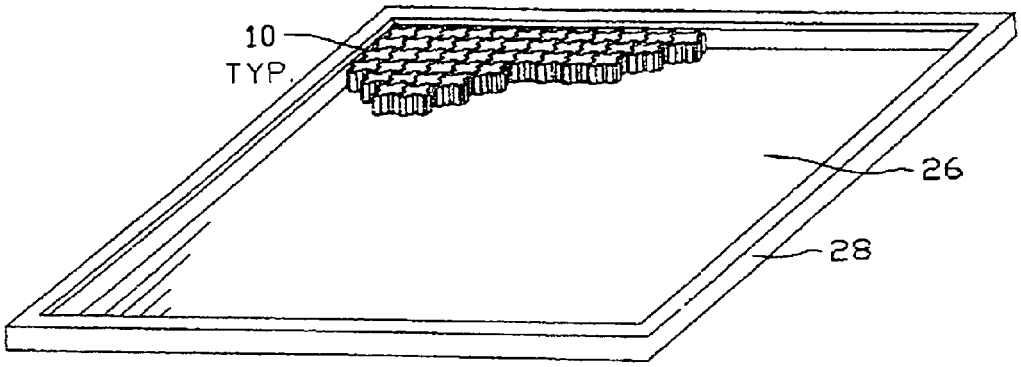
FIG. 35 is a perspective view of a two-dimensional array of pixel blocks assembled in a frame.

FIG. 35 is a perspective view of a two-dimensional array of pixel blocks 10 assembled in a frame 28 surrounding the array, the frame 38 having a planar backing member 26 and each of said blocks 10 having a surface abutting the backing member 26.

Figure 36:
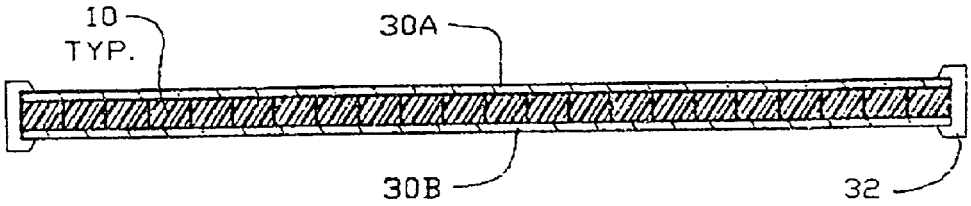
FIG. 36 a cross-section taken through a two-dimensional array of pixel blocks, sandwiched between two transparent panels retained by a surrounding frame

FIG. 36 is a cross-sectional view of a two-dimensional array of pixel blocks 10, sandwiched between two transparent panels 30A and 30B retained by a surrounding frame 32. A mixture of transparent pixel blocks and translucent pixel blocks of various colors can provide a stained-glass window effect.

Figure 37:
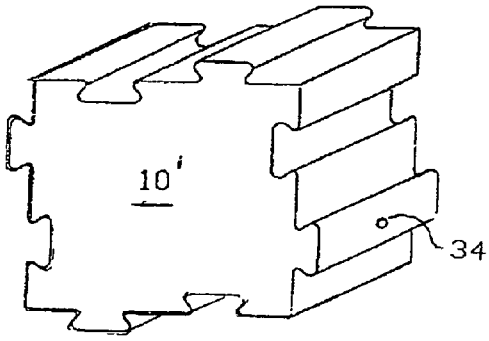
FIG. 37 is a perspective view of a pixel block configured with a circular nub located on a tongue surface.

FIG. 37 is a perspective view of a pixel block 10 configured with a circular nub 34 located centrally on a tongue surface. Nub 34 is a residual quantity of molded plastic material left at that location as a normal by-product of injection molding of the pixel block 10' following injection of plastic molding material at that location. Typically there is only one such nub formed in this manner on each pixel block, however with appropriate dimensioning of the pixel block it can serve to provide a frictional fit that can stabilize a vertical or supported horizontal array of pixel blocks. With suitable dimensioning of the pixel blocks, arrays can be assembled utilizing these nubs 34 as an alternative to the stability bars 12A shown in FIG. 3, however because they acts only at central point on one tongue in each pixel block, a horizontal array of any but very small size will fail to be self-supporting overhead due to teeter-tottering effect at each nub 34, whereas with four stability bars 12A on each pixel block 10 as shown and described above, one of the bars 12A may actually incorporate a buried nub 34. Properly dimensioned for friction, an overhead array can be self-supporting, supported only around the perimeter of the array.

The deployment of 3D pixel blocks 16 (e.g. as in FIGS. 6-8) is not restricted to 3D art objects; they can be deployed for example in designated locations amongst basic pixel blocks 10 (FIGS. 1-3) in a single layer XY matrix panel for the purpose of electric lighting, for which wiring accommodation may be provided by wiring channels 10C in basic pixel blocks 10 and wiring channels 16D and passageways 18B in 3D pixel blocks 16.

The location of stability bar 12A as shown centered on a tongue 12 of each pixel block is considered optimal, however the invention could be practiced with stability bar located elsewhere on tongue 12 or in the groove 14.

The "jigsaw puzzle" shape of the tongues 12 and grooves 14 shown is considered optimal, however the invention could be practiced with other interlocking shapes as long as they have e form of enlargement that enables them fit and hold together in an interlocked manner. In one approach, the enlargement is made small enough that attached pixel blocks can be snapped apart in a twisting action rather than the usual sliding displacement between the tongues and the grooves.

As an option, pixel blocks may be configured with a generally cylindrical opening in a surface thereof to serve at least one of the following two functions: (1) engagement of an insertion tool tip for assembly of said pixel blocks and (2) engagement with an optic fiber end for lighting effects.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A plurality of interlocking pixel blocks, directed to serving as pixels, i.e picture elements, in graphics displays, each pixel block comprising:

a first flat surface extending over a least a major portion of a region bounded by a generally polygonal outline in a first XY plane;

a second flat surface extending over at least a major portion of a region bounded by a like polygonal outline in a second XY plane parallel to the first XY plane and separated therefrom by a designated Z axis thickness dimension;

a plurality of edge facets corresponding to facets of the polygonal outline, each extending between a corner formed with said first flat surface and a corner formed with said second flat surface;

at least a first and a second of said edge facets being configured with at least one tongue-and-groove pair consisting of a protruding tongue configured in a first region of each edge facet and a similar shape groove configured in a second region of each edge facet, the tongue and groove being shaped to fit and interlock with a mating groove and tongue respectively of an adjacent one of said pixel blocks, such that said pixel blocks may be assembled together in an interlocking manner at the edge facets to form a panel in a two-dimensional interlocked array of said pixel blocks; and at least one stability bar configured in each of said pixel blocks, located within a cross-sectional outline of the tongue-and-groove pair thereof, said stability bar extending from the first plane to the second plane, made and arranged to stiffen and stabilize a panel assembled from a plurality of said interlocking pixel blocks.

2. The pixel blocks as defined in claim 1, wherein the plurality of edge facets in each pixel block comprise four substantially identical edge facets, the polygonal outline of the pixel block thus made to have a square outline shape, the edge facets having equal X-axis and y-axis dimensions.

3. The pixel blocks as defined in claim 2 wherein said pixel blocks are made generally cubic in shape, of which the block thickness dimension in the Z axis being made substantially equal to the X-axis and y-axis dimensions and wherein each facet is configured with one tongue and one groove.

4. The plurality of pixel blocks as defined in claim 2, wherein each said pixel block comprises four said stability bars, each located on an outward-facing surface of a corresponding one of the four tongues.

5. The plurality of pixel blocks as defined in claim 2, wherein each said pixel block comprises four said stability bars, each located on an outward-facing surface of a corresponding one of the four grooves.

6. The pixel blocks as defined in claim 1 comprising a plurality of said pixel blocks selected to have various individual visual attributes selected from a group of attributes including color, surface texture, light transmission and transparency, interlocked into a two-dimensional array constituting a graphics artifact in which each pixel block serves as a picture element.

7. The pixel blocks as defined in claim 1 wherein each of the edge facets of the polygon is made to have a cross-sectional shape comprising;

a first flat portion extending from a corner of the polygon to a first neck end boundary of the tongue outline;

a second flat portion extending in a central region from a second and opposite neck end boundary of the tongue outline to a first neck end boundary of the groove; and a third flat portion extending from a second and opposite neck end boundary of the groove to a corner of the polygon adjacent the first corner thereof;

all three said flat portions being located in a common plane defining a facet of the polygon.

8. The pixel blocks as defined in claim 1 wherein said pixel blocks are assembled together in the two-dimensional interlocked array of said pixel blocks supported in a frame surrounding the array, the frame having a planar backing member and each of said pixel blocks having a surface region interfacing the backing member.

9. The pixel blocks as defined in claim 8 wherein said two-dimensional array of said pixel blocks is assembled in a frame surrounding the array, the frame having a planar backing member and each of said blocks having a surface abutting the backing member.

10. The pixel blocks as defined in claim 1 wherein said first and second flat surfaces are made flat over a total area bounded by the polygonal outline.

11. The pixel blocks as defined in claim 1, in an embodiment wherein each pixel block further comprises:

a cylindrical post located concentrically within the polygonal outline, surrounded by said first flat surface and extending therefrom to a designated post length dimension smaller than the Z-axis dimension; and a cylindrical post hole opening located concentrically in the pixel block within the polygonal outline, having an open end surrounded by said second flat surface and extending inwardly, said opening being dimensioned and arranged to accept insertion of a cylindrical post of an adjacent pixel block in a frictional fit, thus enabling layers to be joined together for purposes of assembling multi-layered panels and other three-dimensional objects.

12. The pixel blocks as defined in claim 11, each further comprising:

a cylindrical opening extending from said cylindrical post hole opening extending into a major region of said cylindrical post, serving to provide space for inserting an electric lamp.

13. The pixel blocks as defined in claim 12 wherein said two-dimensional array of said pixel blocks, including at least a predominant proportion of translucent pixel blocks of various selected colors, is sandwiched between two transparent panels retained by a surrounding frame, so as to provide a stained-glass window effect.

14. The pixel blocks as defined in claim 1 wherein each of said edge facets is configured with three separate flat regions disposed inline in a common plane corresponding to a typical edge facet of the polygonal outline:

a first flat region extending from a polygon corner to a first end of a tongue outline;

a second flat region located centrally in the typical facet extending from a second end of the tongue outline to a first end of groove outline; and a third flat region extending from a second end of the groove outline to a next polygon corner.

15. The pixel blocks as defined in claim 1, wherein said pixel blocks are injection-molded from plastic material, each pixel block further comprising: a circular protruding nub, originating as a residue from injection molding of the pixel block, located on a surface interfacing an adjacent pixel block and utilized to enhance mutual retention of the pixel blocks and thus stabilize assemblies thereof by providing a frictional engagement effect at interfacing surfaces of said pixel blocks.

16. The pixel blocks as defined in claim 1, wherein at least some surfaces of at least some of said pixel blocks are made to have a surface texture of mirror-quality finish so as to reflect light and thus enable said pixel blocks to respond to illumination with a distinctive optical effect of bright appearance.

17. The pixel blocks as defined in claim 1, wherein each of said pixel blocks is configured with a generally cylindrical opening in a surface thereof to serve at least one of the following two functions: (1) engagement of an insertion tool tip for assembly of said pixel blocks and (2) engagement with an optic fiber end for lighting effects.

18. A plurality of pixel blocks, all having a substantially identical cross-sectional shape in an X-Y plane, the shape being substantially square with four substantially identical edge facets, each configured with a protrusion and a cavity disposed adjacent to each other, located symmetrically about a central point of the facet, the protrusion and the cavity being made mirror-image complementary to each other in shape, each having a narrower portion, based along a portion of the facet, leading to a wider portion, thus forming a tongue and a groove of a tongue-and-groove pair such that said pixel blocks are enabled to interlock together on all edge facets to form a two-dimensional array in which each pixel block serves as a basic structural, optical and graphic element of an artifact thus formed, said pixel blocks being made to have a designated length along a Z-axis perpendicular to the X-Y plane and being made substantially uniform in cross-sectional shape throughout the length so as to enable said pixel blocks to be assembled into three-dimensional artifacts by sliding displacement along the Z-axis, each said pixel block being configured with at least one stability bar located in an edge facet region encompassed by the associated tongue-and-groove pair, said stability bar, extending along the Z axis to the designated length, being made and arranged to stiffen and stabilize a panel assembled from a plurality of said interlocking pixel blocks.

19. The plurality of pixel blocks as defined in claim 18, wherein each said pixel block comprises four said stability bars, each located on an outward-facing surface of a corresponding one of the four tongues.

20. The plurality of pixel blocks as defined in claim 18, wherein each said pixel block comprises four said stability bars, each located on an outward-facing surface of a corresponding one of the four grooves.

* * * * *